United States Patent [19]

Loggins, Jr. et al.

[11] 4,361,406

[45] Nov. 30, 1982

[54] APPARATUS FOR MIXING SALVAGED ASPHALT MATERIAL

[75] Inventors: Ted C. Loggins, Jr., Rowland Heights; John P. Selberg, Los Angeles; Rudolf W. Rapmund, Placentia, all of Calif.

[73] Assignee: Allis-Chalmers Corporation, Milwaukee, Wis.

[21] Appl. No.: 275,453

[22] Filed: Jun. 22, 1981

Related U.S. Application Data

[63] Continuation-in-part of Ser. No. 75,414, Sep. 14, 1979, abandoned.

[51] Int. Cl.[3] ..... B28C 5/46

[52] U.S. Cl. ..... 366/25

[58] Field of Search ..... 366/25, 24, 23, 30, 366/33, 41, 54, 150, 183, 228, 220, 233; 414/149, 468

[56] References Cited

U.S. PATENT DOCUMENTS

| | | | |
|---|---|---|---|
| 2,030,645 | 2/1936 | Lockridge | 414/149 |
| 2,812,865 | 11/1957 | Rohde | 414/149 |
| 2,923,538 | 2/1960 | Schoonover | 366/228 |
| 3,845,941 | 11/1974 | Mendenhall | 366/24 |
| 3,999,743 | 12/1976 | Mendenhall | 366/4 |
| 4,025,057 | 5/1977 | Shearer | 366/25 |
| 4,039,171 | 8/1977 | Shearer | 366/25 |
| 4,067,552 | 1/1978 | Mendenhall | 366/24 |
| 4,074,894 | 2/1978 | Mendenhall | 366/25 |
| 4,075,710 | 2/1978 | Jakob | 366/233 |
| 4,126,397 | 11/1978 | Mendenhall | 366/25 |
| 4,147,436 | 4/1979 | Garbelman | 366/25 |
| 4,174,181 | 11/1979 | Garmelman | 366/25 |

*Primary Examiner*—Robert W. Jenkins
*Attorney, Agent, or Firm*—Robert C. Jones

[57] ABSTRACT

An elongated drum for mixing asphalt materials has a rear inlet end, a front outlet end and a side wall concentric to a substantially horizontal axis about which the drum rotates. For feeding salvaged asphalt material into the drum, the side wall has circumferentially spaced ports in a zone intermediate said ends. As ports move upwardly in their orbits, material falls toward them from the bottom outlet of a hopper above the drum and is guided into them by chutes, one for each port, that are fixed to the side wall and project out from it. Also, fixed to the side wall is an inwardly projecting spout for each port whereby material entering the port is deflected forwardly to fall to the bottom of the drum in front of the ported zone. Material moving forward from the rear of the drum is deflected around the ports by the spout walls. An annular trough-like shroud encircles the drum at said zone, embracing the chutes as they move orbitally and preventing incursion of external ambient air into the ports. A hole in the shroud, in line with the upper outlet, is either blocked by salvaged material in the hopper or is closed by a gate for use with all-virgin materials.

12 Claims, 14 Drawing Figures

APPARATUS FOR MIXING SALVAGED ASPHALT MATERIAL

This application is a continuation-in-part of application Ser. No. 075,414, filed Sept. 14, 1979, now abandoned.

TECHNICAL FIELD OF THE INVENTION

This invention relates to mixing apparatus such as is employed for mixing asphalt aggregates, comprising a drum rotatable about a substantially horizontal axis and having an inlet at a rear end thereof into which material is charged and a front outlet through which mixed material is discharged; and the invention is more particularly concerned with means for feeding another material into the drum at a zone thereof that is between its front and rear ends.

BACKGROUND OF THE PRIOR ART

It has come to be recognized that substantial economies can be achieved in the repair and reconstruction of asphalt pavements if crushed salvaged asphalt material, reclaimed from a previously laid pavement, is mixed with virgin (unused) aggregate. Heretofore, however, there has been no fully satisfactory apparatus for accomplishing continuous hot mixing of virgin and salvaged asphalt materials.

Conventionally, apparatus for continuous mixing of virgin asphalt material comprises an elongated drum rotatable about an axis that is substantially horizontal but is tilted downward towards a front discharge end of the drum. Aggregate material is charged into the rear end of the drum and moves forward by gravity as the drum rotates, while flights or lifts on the inner surface of the cylindrical side wall of the drum agitate and tumble the material. To heat and dry the aggregate as it enters the drum and moves forward in it, a fuel burner projects a flame into the rear end portion of the drum, substantially along the drum axis. Liquefied asphalt cement is introduced into the drum some distance forward of the burner flame, as by means of a duct that extends into the drum from one of its ends. The asphalt cement must be brought into contact with the aggregate when the latter has been highly heated, but it must not enter the drum near the burner flame lest it be heated to a temperature at which it smokes. Smoking should be avoided not only because the binding properties of the asphalt are degraded by the chemical breakdown denoted by smoke but also because the smoke from overheated asphalt is extremely dense and noxious.

Obviously, salvaged asphalt material cannot be introduced into the rear end of a conventional mixing drum, along with the virgin aggregate, because the heat of the burner flame would cause smoking of the asphaltic binder in the reclaimed material. Various arrangements have therefore been proposed for introducing salvaged asphalt material into a mixing drum in such a manner as to prevent its being heated to smoking temperature, but heretofore no completely successful apparatus has been devised by which salvaged asphalt material can be mixed with virgin materials. To be fully satisfactory, such apparatus should be inexpensive, should provide for continuous throughput as opposed to batch processing, should have a high production rate during both recycling operation with salvaged asphalt material and standard operation with all virgin material, should be very quickly and easily convertible from either type of operation to the other, should require little maintenance, and should of course be smokeless.

One prior arrangement intended for use with salvaged asphalt material is represented by several U.S. Patents to R. L. Mendenhall, including No. 3,845,941; No. 4,067,552 and No. 4,074,894. These patents disclosed a mixing drum through which heating tubes extended lengthwise, and hot combustion gases were passed through the tubes for indirect heating of materials in the drum. This apparatus was substantially smokeless, but it was very expensive and had a low rate of production for its size and cost so that it was not satisfactory for standard operation with virgin materials.

Another prior arrangement for mixing salvaged asphalt material consisted of a short, small diameter drum that was coaxially telescoped partway into the rear inlet end portion of a longer, larger diameter drum. A burner flame was projected coaxially into the rear of the smaller drum and virgin aggregate was charged into the rear of that drum to be directly heated by the flame. Salvaged aggregate material was charged into the rear end portion of the larger drum, to be indirectly heated by the flame and to be mixed, while moving forward in the large drum, with the heated virgin material issuing from the front of the small drum. The small drum was removed when all-virgin materials were to be mixed, and the apparatus then had a substantially higher production rate, which is to say that it had a low rate of production when operating with salvaged materials. Owing to the need for installation or removal of the small drum, the apparatus was not readily convertible from one type of operation to the other.

U.S. Pat. No. 4,075,710, to Jakob et al, discloses apparatus which was essentially a conventional drum mixer for virgin materials, modified by the addition of a conveyor that projected rearwardly into the drum from its front discharge end and terminated a distance forwardly of the fuel burner flame, for feeding salvaged asphalt material into a medial portion of the drum. The apparatus was expensive in itself and was also expensive to maintain because moving parts of the conveyor were located in a highly heated zone. The conveyor had to be removed for standard production of all-virgin mix, to minimize conveyor maintenance and because the apparatus had a low production rate in its configuration for mixing salvaged material.

In the drum mixer of U.S. Pat. No. 4,039,171, to Jakob et al, a baffle or heat dispersing grid was mounted in the drum ahead of the burner flame, with the intention of preventing the highly heated burner gases from coming into direct contact with salvaged asphalt material fed into the drum along with virgin aggregate material. However, the apparatus reportedly produced an objectionable amount of smoke when operating with salvaged material. Furthermore, the heat dispersing grid had to be made of heat resistant alloy and was therefore expensive, and it had to be removed for satisfactory use of the mixer with all-virgin materials because the apparatus had a low production rate with the grid in place.

U.S. Pat. No. 3,999,743, to R. L. Mendenhall, discloses a mixer having circumferentially spaced ports in its drum, arranged in one or more zones intermediate the ends of the drum, through which salvaged asphalt material could enter the drum at some distance forward of the burner flame. At each port a scoop was fixed to the side wall of the drum and projected into an annular trough that embraced the drum. Salvaged material was filled into the trough through a chute at its top. As the drum rotated, the several scoops picked up material from the trough and charged it into the interior of the drum through their respective ports. This arrangement was incapable of feeding salvaged asphalt mix into the drum at any substantially high rate, and accordingly it did not lend itself to high rates of production. Furthermore, material moving forwardly through the zone of the ports could fall out of the drum through them at any time material was not being forced into the drum by the action of the scoops, and therefore the apparatus was not suitable for operation with virgin aggregate materials unless the ports were closed in some manner for such operation.

Still another arrangement is disclosed in U.S. Pat. No. 4,147,436 to David L. Garbelman wherein the recycled material is fed into the rotating drum by being dropped into it to the bottom thereby directly passing through the hot flame. To preclude direct exposure of the recyclable aggregate to the hot flame there is provided a flame deflector or heat shield. Also, to prevent the aggregate introduced into the drum at the top so that it remains in the drum until discharged, there is provided a plurality of feeding port covers which close under the influence of gravity as the drum rotates.

Other arrangements have been proposed for feeding material into a rotatable drum through ports or the like in a medial zone thereof, wherein hinged doors or flop gates on the drum opened to permit introduction of material into an upper portion of the drum and closed to prevent escape of material from a bed in the lower portion of the drum. Such hingedly mounted elements were noisy, tended to accumulate build-ups of asphaltic material that interfered with their proper functioning, and had to be secured against opening for use with all-virgin materials and had to be released for conversion to use with salvaged materials.

By contrast with the prior state of the art, the general object of the present invention is to provide a rotatable drum mixing apparatus that provides for charging of materials into the mixing drum in a zone thereof that is between its ends, which apparatus has no parts that are movably mounted on the drum and is therefore highly reliable and easy to maintain, provides for a high and steady rate of feed of material into said medial zone of the drum, prevents escape of materials from the interior of the drum while facilitating passage of materials through said zone, and permits the apparatus to be converted almost instantaneously from its salvaged asphalt material mixing mode to an all-virgin materials mode.

Another general object of the invention is to provide mixing apparatus of the type comprising a drum that is rotatable on a substantially horizontal axis and has an inlet for one kind of material at a rear end thereof and an outlet for discharge of mixed material at its forward end, which apparatus has means for feeding another kind of material into a zone between the ends of the drum at a high and steady rate but is nevertheless so arranged that material moving through said zone from the rear end of the drum cannot escape from the drum in said zone.

A more specific object of the invention is to provide a rotary drum mixer that is suitable for use with either salvaged asphalt material or all-virgin material, with high rates of production in both cases, and which can be converted for use with one or the other of such materials by the mere stopping of the recycle feed conveyor.

It is a further specific object of this invention to provide a rotary drum mixer wherein the drum has circumferentially spaced charging ports around a zone between its ends, and wherein means which are fixed on the drum to rotate with it, and which do not move relative to it, guide infeed material through the ports to the interior of the drum from a hopper above it and also prevent the incursion of external air into the drum and the escape of solid materials that move through the interior of the drum past the zone of the ports.

It is also a specific object of the invention to provide a rotary drum mixer that has a ported cylindrical side wall, wherein said side wall is reinforced at its ported zone by chute structure which serves to guide material into the drum from a hopper above it.

BRIEF SUMMARY OF THE INVENTION

In general, the objects of the invention are achieved with mixing apparatus comprising an elongated drum that is driven for rotation about an axis that is slightly inclined to the horizontal and has a side wall concentric to said axis, and which drum has an inlet for one material at a rear end thereof, an outlet at its forward end from which mixed material is discharged, and feed means by which other material can be charged into the drum through its side wall at a zone between its ends, said feed means being characterized by: a hopper spaced above said side wall, located and arranged to discharge said other material downwardly towards each of a plurality of ports in said side wall that are circumferentially spaced from one another around said zone; a plurality of chutes, one for each port, fixed on said side wall and projecting outwardly therefrom, each chute being so arranged adjacent to its port that material which falls from the hopper when the chute is therebeneath is guidingly constrained by the chute to enter its port; and a plurality of spouts in the interior of the drum, one for each port, secured on said side wall and projecting inwardly therefrom, each of said spouts being arranged so that the flow of material is at a downward angle from a horizontal line which is parallel to the axis of the drum. The trajectory is substantially in a vertical plane parallel to the axis and along the surface of the drum thereby avoiding direct contact with the hot flame or gases. This imparts an inward and forward deflection to material that falls through its port, so that such material is carried forwardly across ports therebeneath, and each spout serving to prevent escape of material through its port from the interior of the drum. Preferably, each of said spouts has a wall portion that extends in an obliquely fore-and-aft direction that serves as an impeller whereby material passing through the drum from rear to front thereof along the interior wall surface of the drum is urged through said zone in consequence of drum rotation. To prevent incursion of external air into the drum through the ports, a fixed through-like shroud embraces the drum around its ported zone, and the chutes move in that shroud. Since the hopper opens downward into said shroud, there is a gate in the hopper that can be closed to prevent incursion of external air into the shroud when there is no material in the hopper.

BRIEF DESCRIPTION OF THE DRAWINGS

In the accompanying drawings, which illustrate an embodiment of the invention now regarded as the preferred mode of carrying out the essentials thereof that are defined by the claims:

DETAILED DESCRIPTION OF THE INVENTION

Figures 1, 2:
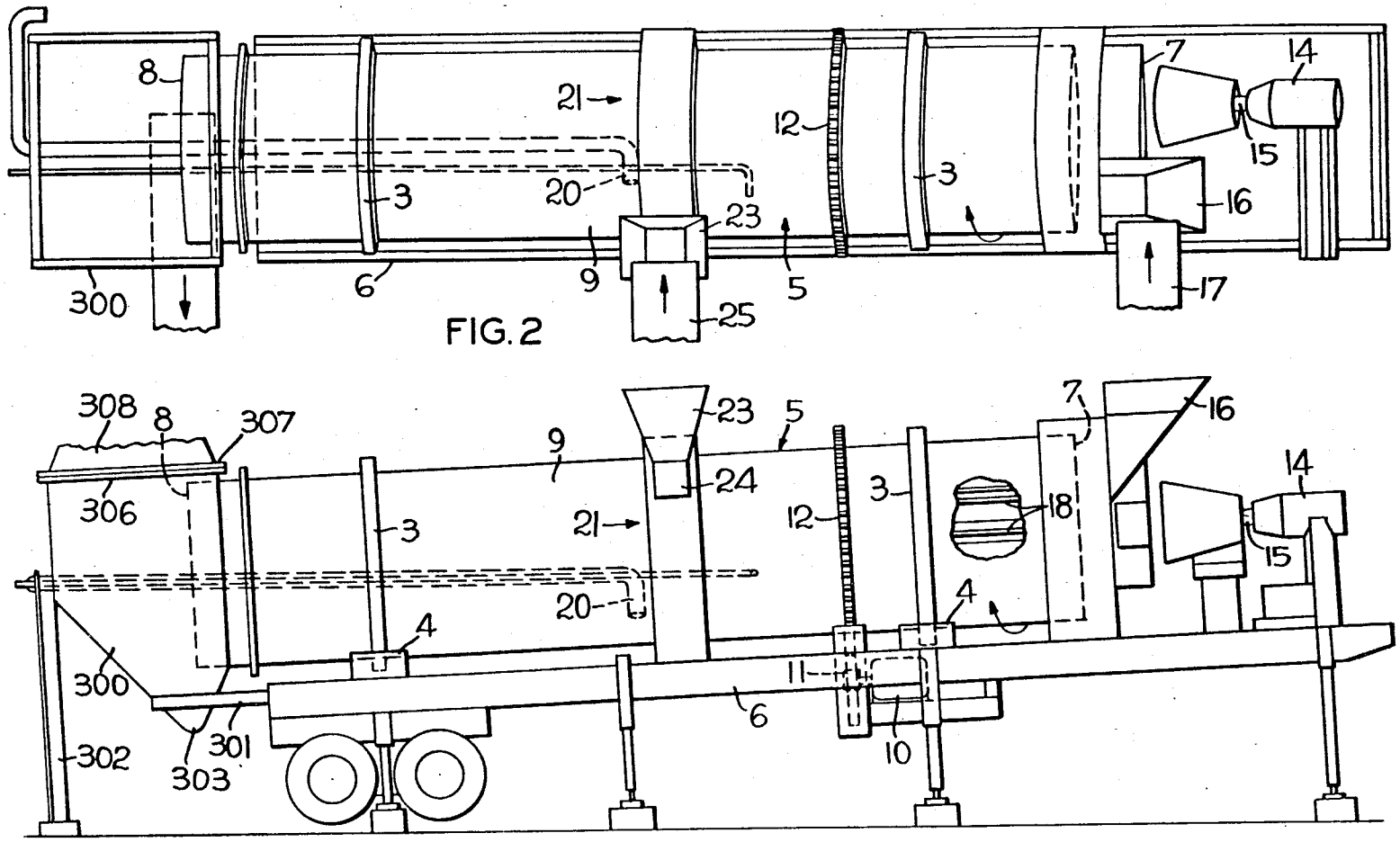
FIG. 1 is a view in side elevation of mixing apparatus of this invention.
FIG. 2 is a plan view of the mixing apparatus.

Referring now to the accompanying drawings, wherein mixing apparatus embodying the principles of this invention is illustrated by way of specific example as a mixer for asphalt paving material, such apparatus comprises an elongated drum 5 that is rotatably mounted on suitable supporting means 6, here illustrated as a flatbed trailer chassis. The drum 5 rotates about an axis which can be regarded as substantially horizontal but which tilts downward from a rear end 7 of the drum to its front end 8. The generally cylindrical side wall 9 of the drum is of course concentric to its axis of rotation. As is conventional, the drum is supported for its rotation on roller sets 4 that are mounted on the supporting means 6 and engage axially spaced annular rails 3 that surround the drum side wall 9.

The drum 5 is rotated by a suitable drive means, illustrated as comprising a motor 10 having on its drive shaft a coaxial pinion 11 that meshes with a ring gear 12 surrounding the drum.

At the rear end 7 of the drum, which is its inlet end, a fuel burner 14 is arranged to project a flame 15 a distance into the drum substantially along its axis. Virgin aggregate for asphalt paving mix is fed into the rear of the drum, as by means of a chute 16 to which the material is delivered by a conveyor 17. In the interior of the drum there are circumferentially spaced flights or lifters 18 that extend along the drum side wall 9. They lift and tumble the aggregate material as the drum rotates, exposing all portions of the material to the heat of the flame 15 and the combustion gases that move forwardly from it, and they cooperate with the inclination of the drum axis to cause the aggregate material to move forwardly through the drum.

Figure 11:
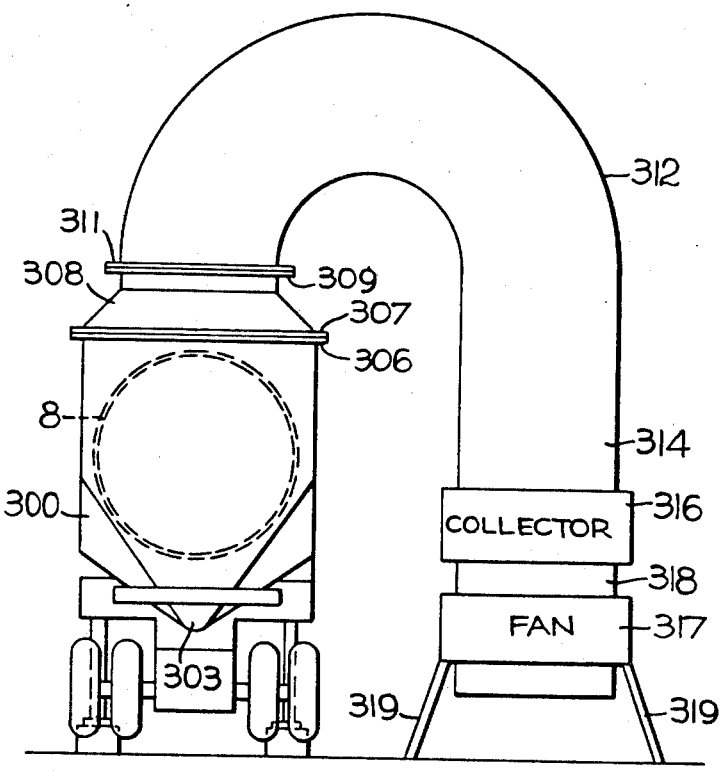
FIG. 11 is a view in elevation of the front or discharge end of the apparatus.

As shown in FIGS. 1 and 11, the front end 8 of the drum 5 extends within a hood or hopper structure 300 supported from frame members 301 and 302 which are an extension of the supporting means 6. The lower portion 303 of the hopper 300 serves as a discharge chute for the material received from the discharge end 8 of drum 5. The upper portion of the hopper 300 is open and provided with a flange 306 that is adapted to receive the flange end 307 of a transitional duct 308. The upper or opposite end of the duct 308 is also provided with a flange as at 309 that mates with the flange end 311 of a U-shaped duct 312. As shown in FIG. 11, the opposite end 314 of the duct 312 is in communication with a dust collector or washer 316 of any well-known type. The collector 316 serves to remove substantially the major portion of the dust particles from the exhaust gas stream moving through the system from the drum 5. The exhaust gas from the drum 5 is drawn through the collector 316 by operation of an exhaust fan 317 which is connected to the collector 316 by means of an interconnecting duct piece 318. The cleansed gas is then expelled to the atmosphere. Supporting structure herein shown as leg members 319 support the exhaust system.

Liquified asphalt binder is introduced into the drum at a location spaced a substantial distance ahead of the flame 15, as by means of a delivery duct 20 that extends into the drum from its front or discharge end 8.

In currently known drum mixers recycle systems having central RAP material entry, hot gases are allowed to pass through the showering RAP material. Hot gases are usually at temperatures of between 700° F. and 800° F., when passing through the central portion of the drum. If these hot gases are permitted to come into direct contact with the RAP material fines, charring or burning of the asphalt that coats the fine particles will occur causing blue smoke emissions. As an additional protection against unwanted burning of the RAP fines, there is provided an homogenizing or mixing without showering zone 360.

Figure 12:
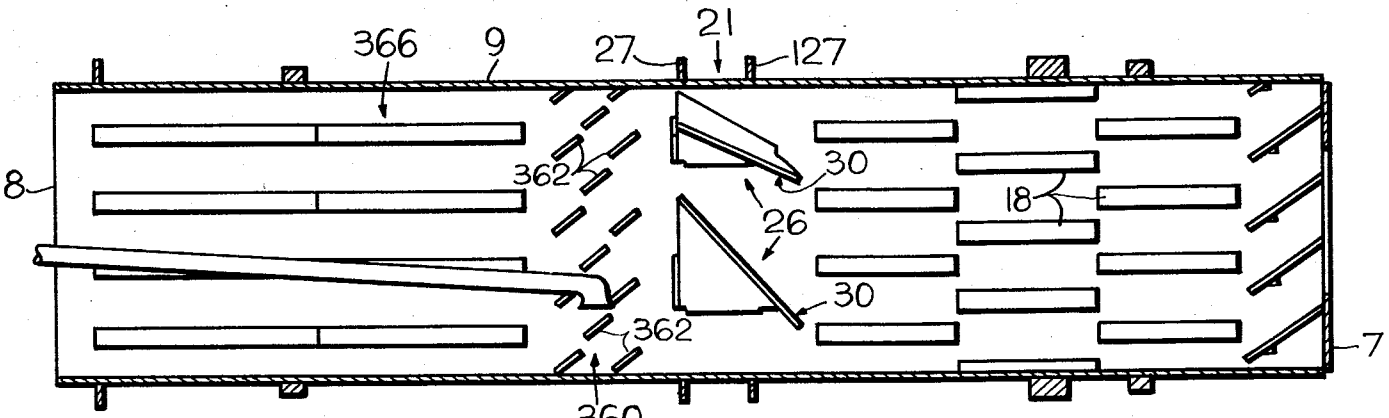
FIG. 12 is a longitudinal view in vertical section through the drum showing the various zones and the homogenizing section within the drum.
Figure 14:
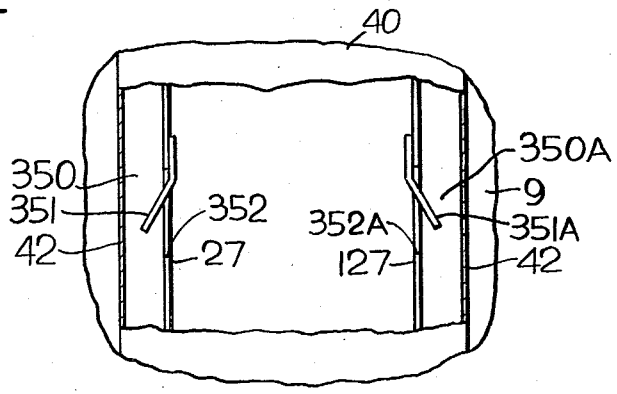
FIG. 14 is a fragmentary view of a portion of a material chute showing the relationship of the shroud cleaning scoops.
Figure 13:
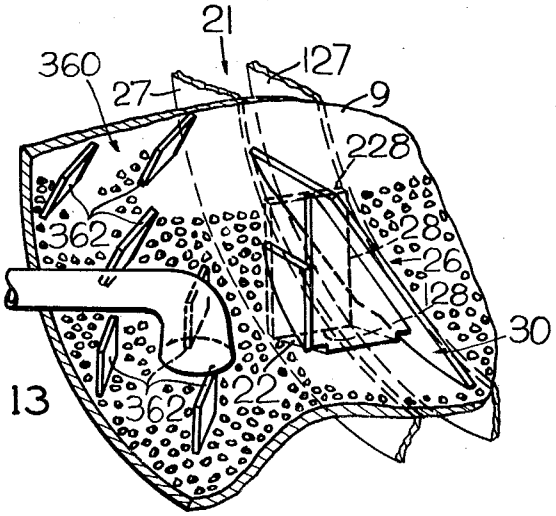
FIG. 13 is a fragmentary view through the mixing—without—showering zone showing the homogenizing blades as they accomplish the mixing and blending process between the virgin material, RAP material and asphalt liquid.

To this end, as shown in FIG. 12, the chutes 26 which slope forward toward the discharge end 8 of the drum 9 are enclosed, as will be described, to the beginning of a zone 360 wherein mixing without a showering effect is accomplished. Within zone 360 there is provided a plurality of rectangular steel blades 362 set at 45° to the longitudinal axis of the drum 9. These blades 362 have been termed homogenizing or mixing blades and are arranged in three mutually staggered circular rows as shown in FIG. 13. The purpose of the mixing blades is to accept the material entering into the drum via the chutes 26 and mix that material with the hot virgin material moving into the zone. It should be noted that up to this point, the RAP material has not been showered and has not been directly subjected to the hot gas stream. As the RAP material and the virgin material move through zone 360, the mixing blades cause mixing to occur without showering. Although the virgin material enters zone 360 at a temperature of 375° F. to 425° F., the charring or burning effect on the RAP material is much less than that caused by hot gases. The fines in the RAP material are quickly enveloped or mixed with the virgin material as it passes through the mixing zone 360. Located halfway through the mixing zone is the virgin asphalt injection pipe; the balance of new asphalt needed to bring the final mix up to material specifications is added at this point. The newly injected asphalt mixes with the RAP and virgin material to form a hot sticky mass which further entraps the RAP fines in the mix. The shape of the asphalt injection pipe discharge is elongated such that the asphalt injection gives maximum coverage over the zone 360. The major axis of the elongated asphalt discharge nozzle can be parallel to or at a maximum of 45° to the longitudinal drum axis in order to obtain optimum asphalt injection coverage. At the end of zone 360, both the coarse and fine RAP material is thoroughly mixed with virgin aggregate and asphalt and is then ready for mixing by showering through mixing zone 366. It is important to note with the arrangement depicted, the system blends or mixes the RAP material with the hot virgin aggregate and liquid asphalt with minimum direct contact with the hot 700° F. to 800° F. gases. Mixing by showering only begins to occur when the mixture enters the mixing with showering zone 366. At this point, the RAP fines are well mixed in with the hot sticky mixture. The fact the vast majority of the original RAP fines are enveloped within the veils of material showering from the lifters, prevents their direct contact with the burning or charring hot gases flowing through the drum.

Salvaged asphalt material, when it is being used, is charged into the drum at an entry zone 21 that is between its ends, far enough ahead of the flame 15 to prevent the asphalt binder content of the salvaged material from being heated to its smoking point but close enough to the flame so combustion gases from the flame can rapidly heat the used material to dry it and soften its asphalt binder content. The salvaged material is charged into the drum from a hopper 23, through ports or apertures 22 in the side wall 9 of the drum that are located in the zone 21 and are spaced at regular circumferential intervals around the side wall. The hopper 23, which is carried by the supporting means 6, is spaced above the upper portion of the drum and is so located that material falls from its bottom outlet directly towards a port 22 which may be beneath it at the time. Material is carried up to the hopper 23 by means of a conveyor 25.

Material that falls from the hopper 23 is guided into the ports 22 by means of chutes 26, one for each port, that are fixed on the exterior of the drum side wall 9 to move orbitally with drum rotation. Every chute 26 is defined in part by a pair of annular flange plates 27, 127 that surround the drum side wall 9 at opposite ends of the ported zone 21 and project edgewise radially outwardly from the side wall. In addition, the chute 26 for each port 22 comprises a flat rectangular chute plate 28 that has end edges engaged against the respective flange plates 27, 127 and opposite longitudinal edges 128, 228 that extend parallel to the drum axis. The plane of each chute plate 28 is substantially tangential to the side wall 9 of the drum, and the chute plate extends across its port 22 at an orientation such that it diverges radially outwardly and in the direction of drum rotation from the circumference of the drum. Therefore, each chute plate has a leading longitudinal edge 128 that is spaced radially outwardly from the cylindrical drum wall 9 and is in line with the peripheries of the flange plates 27, 127, while the opposite or trailing edge 228 of the chute plate is at the surface of the drum wall 9.

The flange plates 27, 127 and the chute plates 28 are secured to one another and to the side wall 9 of the drum by weldments; hence they comprise a rigid chute assembly structure that reinforces the drum and compensates amply for the presence of the rather large ports 22 in the drum side wall 9, which would otherwise tend to weaken the drum.

Figure 4:
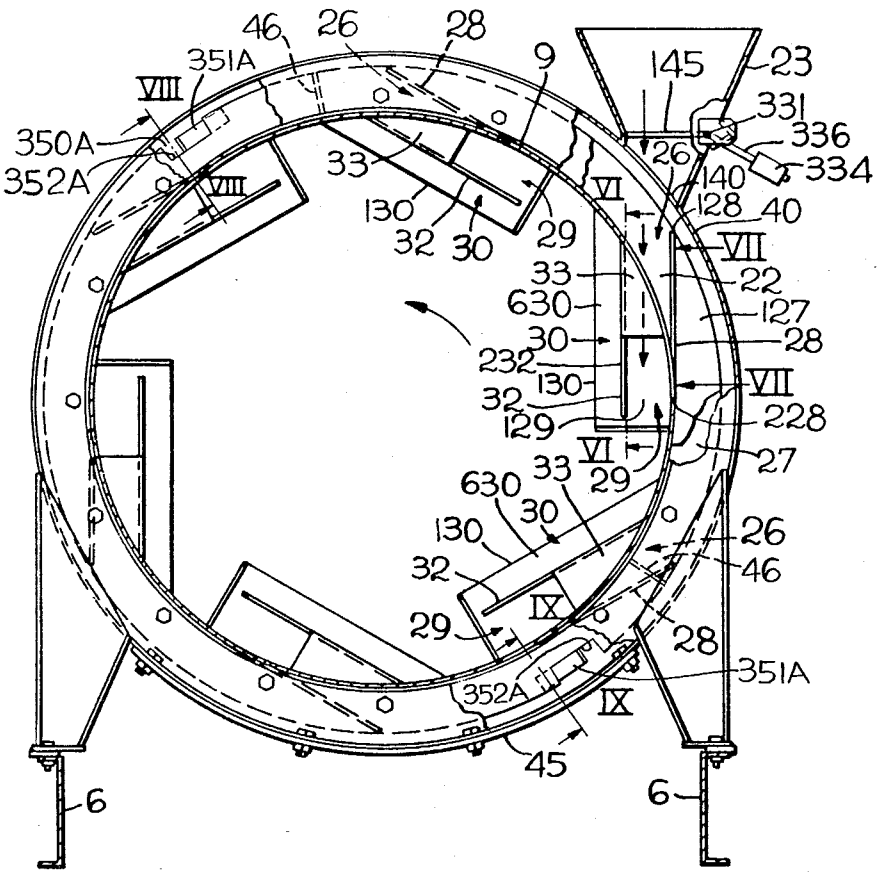
FIGS. 4 and 5 are views in section, taken on the planes of the lines IV—IV and V—V, respectively, in FIG. 3.

As best seen in FIG. 4, the hopper 23 is spaced a distance to one side of the vertical plane containing the axis of the drum and is at the side of that axis in which the chute plates 28 move upwardly in their orbits. Hence, material falling from the hooper 23 is intercepted by the upwardly moving chute plates, which guide such material through the ports 22 and radially into the interior of the drum along the interior wall surface of the drum so the RAP material is gradually heated. Thus, the fines usually present in RAP material are prevented from being allowed to come into direct contact with the hot gases. This eliminates a substantial amount of charring and burning of the asphalt that coats the fine particles thereby reducing blue smoke emissions.

Figure 5:
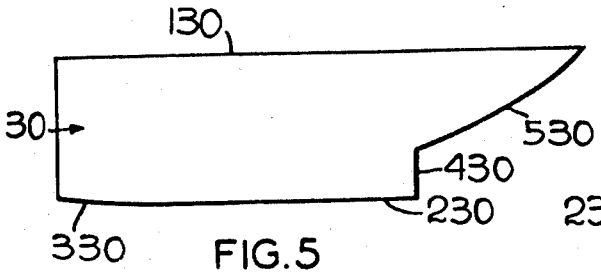

For each port 22 there is a spout 29 in the interior of the drum by which incoming material is deflected forwardly beyond the ported zone 21, to fall to the bottom of the drum in front of ports 22 that are below the one through which the material entered the drum. As here shown, each spout 29 comprises a spout plate 30 that cooperates with the chute plate 28 for its port 22 in guiding material into its port. Each spout plate 30 is substantially elongated, as best seen in FIG. 5, which shows one of the spout plates in plan view. One longitudinal edge 130 of each spout plate is straight along its entire length. Its other longitudinal edge is straight and parallel to the edge 130 along a major portion of its length, as at 230, but is curved as at 330 near one end of the plate and has a step or jog 430 near the other end of the plate, whence it curves, as at 530, to intersect the first-mentioned longitudinal edge 130 at a sharp point. Each spout plate is secured, as by welding, to the inner surface of its chute plate 28 and to the side wall 9 of the drum.

Figure 3:
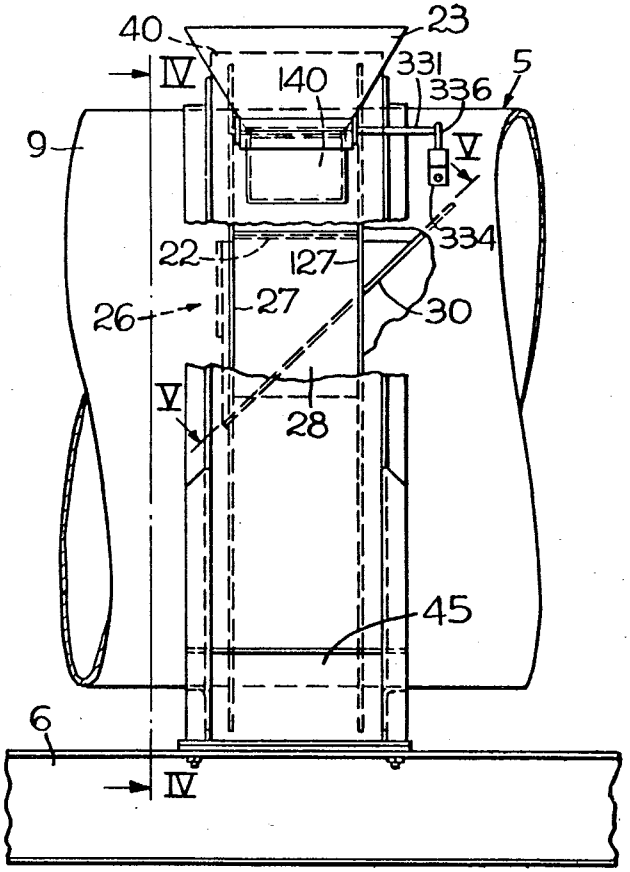
FIG. 3 is a fragmentary view in elevation, on a larger scale, showing the medial portion of the drum with parts broken away.

Considering the spout plates 30 in the upwardly moving portion of their orbit, as seen in FIG. 3 and in the right-hand half of FIG. 4, each spout plate is inclined along its length at a substantial oblique angle to the drum axis, to have its front end substantially lower than its pointed rear end, as best seen in FIG. 3, so that it extends diagonally across its rectangular port 22. Across its width, each spout plate is normal to its adjacent chute plate 28 and it thus extends widthwise substantially radially to the drum wall. As can be seen in FIG. 3, and as is also apparent in FIG. 4, the length of the spout plate 30 is such that its end portions project some distance beyond its port 22. Thus, the upper curved edge portion 530 is contiguous to the inner surface of the drum wall behind and above its port 22, and its lower curved edge portion 330 is similarly contiguous to the drum wall in front of and below the port, the curvature of the spout plate edge portion being in each case matched to the curvature of the inside surface of the drum wall 9 that it adjoins. The straight longitudinal edge portion 230 of each spout plate adjoins the inner surface of its chute plate 28, diagonally all across the chute plate. The short lateral job edge 430 of the spout plate adjoins the front surface of the rear annular flange plate 127. Although for simplicity the ports 22 are formed by rectangular cut-outs from the side wall 9 of the drum, the lower rear corner portion of each port is effectively blocked by the corner portion of the spout plate that is defined by its intersecting straight edges 230 and 430, in cooperation with the rear flange plate 127 and the lower rear portion of the chute plate 28.

Each of the spouts 29 is defined by two further plate-like wall members that cooperate with the spout plate 30; namely a triangular plate 32 and a small sector-like plate 33.

Figure 6:
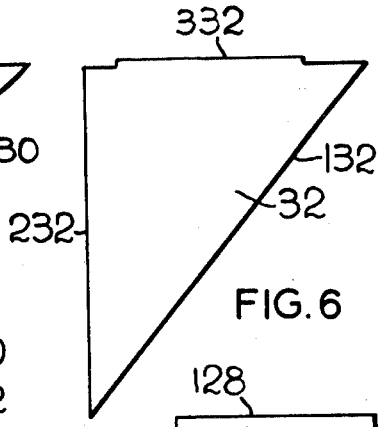
FIGS. 6, 7, 8 and 9 are views taken on the planes of the lines VI—VI, VII—VII, VIII—VIII and IX—IX, respectively, in FIG. 4.
Figure 10:
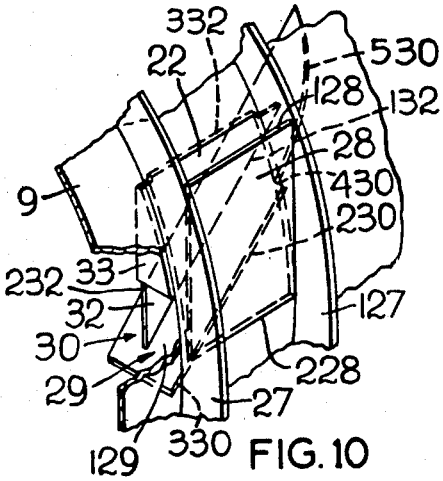
FIG. 10 is a fragmentary perspective view, with portions shown cut away, at a port that is moving upward in its orbit.
Figure 7:
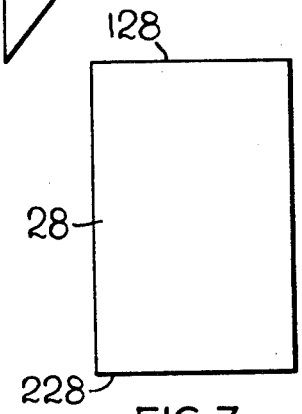

The triangular plate 32, which is seen in plan view in FIG. 6, has an upper edge 332 which extends across the upper edge of its port 22; and from that edge of the port the triangular plate extends downwardly and inwardly of the drum, flatwise parallel to the chute plate 28. The oblique edge 132 of the triangular plate adjoins the upper surface of the spout plate 30 and is secured thereto by welding. Note that the spout plate 30 extends edgewise laterally a distance radially inwardly beyond the connection with the triangular plate 32, to define a lifter portion 630 of the spout plate that can be seen in FIG. 4. The triangular plate 32 extends edgewise a short distance in front of the port 22 and a somewhat greater distance behind it.

The sector-like plate 33, which is flatwise normal to the drum axis and is thus seen in plan view in FIG. 4, extends from the front edge 232 of the triangular plate 32 to the drum wall, but its lower edge is spaced a distance from the chute plate 30. Thus, the spout outlet 129, which opens towards the front end of the drum, is between the lower edge of the sector-like plate 33 and the lower portion of the spout plate 30, and between the front edge of the triangular plate 32 and a portion of the drum wall 9.

It will now be seen that material issuing from the hopper 23 falls between the annular flange plates 27, 127 and onto the radially inner face of a chute plate 28 by which it is given a tangential inward motion relative to the drum. As it slides along the chute plate 28, it encounters the spout plate 30, by which it is deflected axially forwardly relative to the drum. In moving forwardly and inwardly along the spout plate 30, the material is confined between the parallel walls provided by the chute plate 28 and the triangular plate 32. Note the lower end portion of the spout plate 30 projects a little beyond the spout outlet 129 (i.e., beyond the plane of the sector-like plate 33) to provide a lip which ensures that material issuing from the spout outlet will be carried forward of spout outlets therebeneath.

As each spout 29 moves through the bottom portion of its orbit during drum rotation, it passes through any material that may be present in the drum and moving from rear to front thereof. By reason of the arrangement of each spout 29, and particularly by reason of the cooperation of its wall portions comprising the spout plate 30 and the triangular plate 32, such forwardly moving material is diverted around the ports 22 and prevented from entering the forwardly opening spout outlets 129. Furthermore, drum rotation causes the lifter portions 630 of the spout plates 30 to impart forward propulsion to both solid and gaseous materials passing through the ported zone 21, owing to the inclination of the surfaces of those lifter portions, so that such materials progress steadily through the ported zone 21 notwithstanding the restrictions presented by the spouts 29.

It should be understood the operation of the exhaust fan 317 creates a negative pressure within the drum 5. This negative pressure is approximately a one-inch water column of draft at the zone 21. To prevent incursion of external air into the drum through the ports 22 by reason of the negative pressure in the drum 5, a trough-like shroud 40, fixed to the supporting means 6, closely embraces the side wall 9 of the drum and the chute assembly comprising the annular flange plates 27, 127. The chutes 26 move orbitally within the shroud 40 which extends completely around the drum but has an opening 140 directly beneath the hopper 23 through which material can fall into the chutes from the hopper. The shroud 40 is channel-shaped in cross-section and has its radially inwardly projecting legs 42 outwardly adjacent to the respective annular flange plates 27, 127 on the drum. The inner edges of the shroud legs 42 are spaced a small distance radially from the drum side wall 9, to prevent interference between that wall and the shroud as the drum rotates, but the gap between the shroud legs and the drum is sealed by resilient seal segments 43 that are secured to the shroud and bear against the drum side wall 9 under flexing bias. The seal segments 43 can be made of flat belting material.

Figure 9:
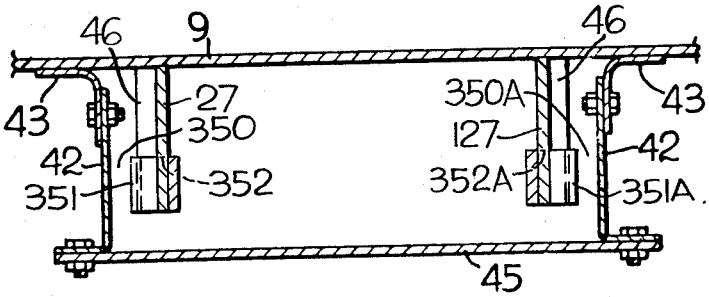

In the event material that falls from the hopper 23 is not caught by one of the chutes 26, such material will tend to accumulate and abrade the portion of the shroud 40 that is near the bottom of the drum and at the side of the drum axis at which the chutes move upward in their orbits. In that portion of the shroud 40, therefore, its outer, axially-extending wall 45 is detachably secured to its legs 42, as best seen in FIG. 9, both to facilitate clean-out of the shroud and to facilitate replacement of the outer wall 45 in that portion of the chute, where wear on the outer wall is greatest. There is clearance all around the shroud between its outer wall 45 and the chute plates 28, so that a small accumulation of salvaged asphalt material in the shroud is of no consequence, and any substantial accumulation tends to be scooped into the drum by the chute plates 28 as they move upwardly in their orbits. Radially extending wiper ribs 46 on the axially outer surfaces of the flange plates 27, 127 stiffen and reinforce them while serving as wipers that dislodge any salvaged asphalt material that may cling to the legs 42 of the shroud.

Figure 8:
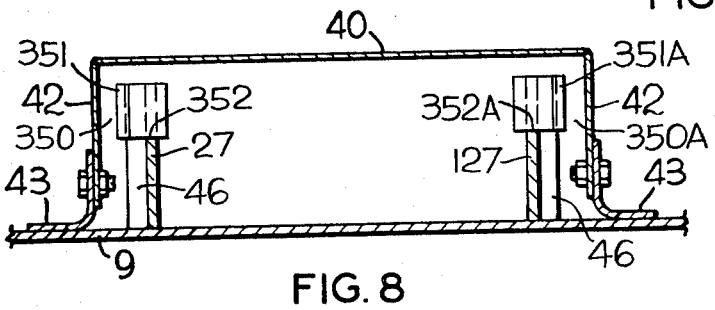

Should a condition arise wherein the wiper ribs 46 cannot adequately clear the space 350 between the shroud 40 and rings 27, 127, a build-up of RAP material therein could cause the shroud plates 42 to buckle. To prevent any chance of excessive accumulation of RAP material in the space 350, there has been provided a plurality of tongues or paddles 351 and 351A which are secured to the rings 27 and 127, respectively, and in opposite location on the respective rings, as shown in FIGS. 8 and 9. As there shown, the paddles 351 and 351A are related to associated openings 352 and 352A formed in the rings 27 and 127, respectively, and extend through the openings 352 and 352A into the space 350 and 350A. Thus, as the drum rotates, the extending ends of the paddles rotating with the drum will deflect the material trapped into in the spaces 350 and 350A into the RAP chute area where it will be scooped into the leading chute plate 28. As shown, there are two paddles 351 located 180° apart associated with the ring 27. Likewise, the ring 127 is also provided with two paddles 351A located 180° apart. These paddles enable the shroud to be self-cleaning, and thus, overcome the inevitable leakage of material between the rings 27 and 127 and the shroud plate 40.

It will be apparent when salvaged asphalt material is to be mixed with virgin aggregate, the salvaged material, crushed and screened to a proper size, is fed into the hopper 23 by means of the conveyor 25, while virgin aggregate is fed into the rear of the drum as by means of the conveyor 17. As is conventional with the mixing of virgin asphalt aggregate, the virgin material is rapidly heated by its direct exposure to the flame 15. As the drum rotates, the material is carried forward through it by reason of the inclination of the drum axis and by the operation of the lifters 18. In the medial portion of the drum, the virgin material is mixed with the salvaged material that enters the drum through the ports 22. The salvaged material is of course thoroughly dried and heated by the hot combustion gases that move forward through the drum from the burner 14, but it is not directly exposed to the burner flame 15 nor otherwise heated to its smoking temperature. Liquified asphaltic material is introduced into the drum through the duct 20, near where the salvaged material falls to the bottom of the drum, and mixing of such binder material with the other materials continues as the bed of material in the drum moves forward to its front discharge outlet 8.

When the apparatus is to be used for mixing all-virgin material, a hatch-like door or gate 145 in the hopper 23 is swung from its inoperative open position, flatwise overlying one wall of the hopper, to an operative position closing the bottom outlet of the hopper. Because the ports 22 in the drum all open into the shroud 40, and the hopper 23 offers the only route through which ambient air could enter the shroud, closure of the gate 145 effectively prevents the outside air from entering into the drum. The gate 145 is secured to a rotatable shaft 331 and urged to a closed position, as shown in FIG. 4, by means of a counterweight 334 adjustably carried on an arm 336 connected to rotate the shaft 331. Thus, when reclaimed asphalt is not being introduced into the drum 5 via chute 23, the gate 145 is moved to a horizontal closed position by operation of the counterweight 334, which is capable of holding the gate closed against the negative air pressure in zone 21 which tends tends to pull the gate downwardly or to an open position. It is apparent when salvaged asphalt material is introduced into the zone 21 through the hopper 23, the weight of the flowing salvaged asphalt material will deflect the gate 145 downwardly sufficiently far enough to permit the material to flow into the drum. Nothing more need be done to adapt the apparatus for standard operation with all-virgin materials, which are mixed in a generally conventional manner.

To reconvert the apparatus for recycling operational use with salvaged material, it is merely necessary to introduce the salvaged asphalt into the hopper 23 to reopen the gate 145 so the reclaimed material can flow through the hopper and into the drum. Incursion of ambient air into the drum is then substantially prevented by the presence of reclaimed material in the hopper 23. It will be apparent the output of the apparatus is not reduced by its use with salvaged material, and could in fact be higher than the very satisfactory rate achieved when the apparatus is used in its standard mix mode.

From the foregoing description taken with the accompanying drawings, it will be apparent this invention provides a mixing apparatus that can be converted almost instantaneously for either standard asphalt mixing, using all-virgin materials, or for mixing salvaged asphalt materials with virgin materials; and the mixing apparatus of this invention is inexpensive, smokeless, trouble-free and capable of high production in both of its mixing modes.

The embodiments of the invention in which an exclusive property or privilege is claimed are defined as follows:

1. In mixing apparatus for reclaimed asphalt paving (RAP) material with virgin paving material comprising an elongated drum (5) that is rotatable about a substantially horizontal axis and has a side wall (9) concentric to said axis, and which drum (5) has an inlet (7) at a rear end thereof and an outlet (8) at its opposite forward end, charging means (23, 26, 29) by which RAP material can be fed into the drum through its side wall at a charging zone (21) between its ends to be mixed with virgin material moving through the drum (5) from said inlet (7) to said outlet (8), said charging means being characterized by:

a hopper (23) spaced above a side wall (9) of the drum (5), said hopper (23) being located and arranged to discharge said RAP material downwardly towards each of a plurality of ports (22) in said side wall (9) that are circumferentially spaced from one another around said zone (21);

a plurality of chutes (26), one for each port (22), fixed on the interior of said side wall (9) of the drum (5) to be moved orbitally by rotation of the drum, said chutes (26) projecting radially outwardly from said side wall (9), each of said chutes (26) being arranged to open upwardly towards the hopper (23) when the chute is in an upper portion of its orbit, each chute being operable to direct the RAP material downwardly and forwardly towards the discharge end without crossing through the axial flow path of hot gases, and each chute (26) having a wall portion (28) which extends obliquely upwardly and radially outwardly from said side wall (9) when the chute (26) is in said portion of its orbit and by which material that falls from the hopper (23) is caught and deflected through its port (22) radially toward the interior of the drum (5) to mix with virgin material in the bed load, a plurality of spouts (29), one for each port (22), fixed on said side wall (9) of the drum (5) to be moved orbitally by drum rotation, each of said spouts (29) projecting into the interior of the drum (5) from said side wall (9); and being in communication through its associated port (22) with the chute (26) for that port, each of said spouts having an outlet (129) which opens substantially toward said forward discharge end of the drum and which is located at the front of said charging zone (21); and, having a wall portion (30) which extends obliquely forwardly and downwardly when its chute (26) is in said upper portion of its orbit and which extends to said outlet (129), whereby material deflected through the port (22) by the chute (26) is further deflected forwardly toward the discharge end to leave said outlet (129) with a forward momentum by which the material is carried forward of the outlets (129) of spouts (29) therebeneath, whereby the RAP material is mixed with virgin material without showering across the hot gas stream so as to materially reduce charring of fine asphalt material particles in the hot gas stream to reduce blue smoke emission.

2. The mixing apparatus of claim 1, further characterized by:

a pair of annular, radially outwardly projecting plates (27, 127) surrounding said side wall (9) of the drum (5) at the front and rear ends of said zone (21) and providing wall portions of the several chutes (26); and a wall portion (28) associated with each chute comprising a substantially flat plate extending fore-and-aft from one to the other of said annular plates (27, 127).

3. The mixing apparatus of claim 1 wherein said hopper (23) is located at a level above the axis of the drum (5) and over the drum at that side of its axis at which the chutes (26) and spouts (29) move upwardly; and wherein said wall portion (28) of each chute (26) is inclined radially outwardly and circumferentially in the direction of drum rotation.

4. The mixing apparatus of claim 1 wherein said wall portion (30) of each spout has a marginal edge portion (630) which projects radially inwardly of the drum (5) beyond the chute (29) proper, to provide an impeller by which material from the rear feed end of the drum is driven through said zone (21) in consequence of drum rotation.

5. A mixing apparatus according to claim 1 wherein each spout (29) is provided with a lower end portion (330) that projects beyond the spout outlet (129) to provide a lip which ensures that RAP material issuing from the spout outlet (129) will be carried forwardly of the spout (29) outlet therebeneath.

6. In mixing apparatus comprising an elongated drum (5) that is rotatable about a substantially horizontal axis and has a side wall (9) concentric to said axis, feed means (23, 26, 29) by which material can be introduced into the drum (9) through circumferentially spaced ports (22) in said side wall (9) that are located in a zone (21) between an axially opposite front discharge end (8) and rear feed end (7) of the drum (5), said feed means being characterized by:

a hopper (23) mounted over said side wall (9) at said zone (21) and in spaced relation to said side wall (9), said hopper (23) being arranged to guide material for fall toward said ports (22);

chute means (27, 127, 28) fixed on the interior of said side wall (9) at said zone (21) and having a portion thereof extending through an associated port, said chute means (27, 127, 28) defining a plurality of chutes (26), one for each port (22), arranged to catch material falling from the hopper (23) and guidingly constrain it to enter the ports (22); and a plurality of spouts (29) in the interior of the drum, one for each port (22), each spout (29)

being fixed to said side wall (9) for motion in an orbit with the drum (5), being communicated through its port (22) with the chute (26) for that port (22), having wall portions (28, 30, 32, 33) by which material at the bottom of the drum is diverted around its port (22) when the spout is in the bottom portion of its orbit, having an outlet (129) which is spaced radially inwardly from said side wall (9) of the drum and which opens substantially toward the front discharge end (8) of the drum (5), and having one of its wall portions (30) inclined forwardly toward the discharge end and radially inwardly and facing substantially upwardly when the spout (29) is in an upwardly moving portion of its orbit, to impart a forward acceleration toward the discharge end to material that falls through its port (22) whereby such material is caused to fall to the bottom of the drum (5) in forwardly spaced relation toward the discharge end to spouts (29) mixing with virgin material without crossing the axial flow path of the hot gas stream.

7. A mixing apparatus according to claim 1 or 6 wherein the mixing drum (9) is provided with a mixing-without-showering zone (360) adjacent to and out the discharge side of the RAP infeed charging zone (21) wherein the RAP material issuing from said chutes (26) is mixed with the hot virgin material that moves into the zone (360) without showering so that the fines in the RAP material are quickly mixed with the virgin material as it passes through the mixing-without-showering zone (360); and, virgin asphalt injection means (20) within said drum (9) and operably positioned midway in the mixing-without-showering zone (360) to add required new asphalt.

8. A mixing apparatus according to claim 7 wherein said mixing-without-showering zone (360) includes a plurality of blades (362) extending from the wall of the drum (9) and arranged in a plurality of rows.

9. A mixing apparatus according to claim 8 wherein said blades (362) have a rectangular configuration and are set at an angle of 45° with respect to the longitudinal axis of the drum.

10. A mixing apparatus according to claim 9 wherein said blades (362) are in three mutually staggered circular rows.

11. A mixing apparatus according to claim 1 wherein said drum is provided with external circumferential spaced apart flange members (27, 127) at the charging zone (21) which cooperate to define side plates of said chutes (26);

a plurality of ports (22) formed in said drum between said flange members (27, 127) in communication with an associated chute;

a stationary shroud (40) assembly disposed around the drum (9) at the charging zone (21) and constructed and arranged to encompass said flange members (27, 127) and operable to prevent incursion of external air into the drum through said ports (22);

clearing means (351, 351A) attached to each flange member (27, 127) and constructed and arranged to extend into a space (350, 350A) defined between each flange member and the side plates of said shroud whereby the rotation of the flange members within the shroud will rotate the cleaning means to clear RAP material from the spaces between the side plates of the shroud and said flange members and thereby prevent an excessive accumulation of material to prevent buckling of the shroud; and, openings in the flange adjacent to said clearing means and arranged to permit the flow of excess material into said chutes from said clearing means.

12. A mixing apparatus according to claim 11 wherein said clearing means includes at least two paddles (350, 351A) attached to each flange member and disposed equidistance apart and associated with a flange opening (352, 352A), said paddles being deformed so as to protrude into the space (350, 350A) between the side wall of said shroud assembly and said flanges, whereby to provide a self-clearing arrangement for said shroud assembly to prevent damage to said shroud assembly by excessive accumulation of RAP material.

* * * * *